US005252452A

United States Patent [19]

Chang et al.

[11] Patent Number: 5,252,452

[45] Date of Patent: Oct. 12, 1993

[54] PROCESS FOR THE PREPARATION OF HIGH CHLORIDE TABULAR GRAIN EMULSIONS

[75] Inventors: Yun C. Chang; Joe E. Maskasky, both of Rochester, N.Y.

[73] Assignee: Eastman Kodak Company, Rochester, N.Y.

[21] Appl. No.: 864,820

[22] Filed: Apr. 2, 1992

[51] Int. Cl.[5] ..... G03C 1/005

[52] U.S. Cl. ..... 430/569; 430/567

[58] Field of Search ..... 430/567, 569

[56] References Cited

U.S. PATENT DOCUMENTS

| | | | |
|---|---|---|---|
| 4,399,215 | 8/1983 | Wey et al. | 430/567 |
| 4,400,463 | 8/1983 | Maskasky | 430/434 |
| 4,414,306 | 11/1983 | Wey et al. | 430/434 |
| 4,713,323 | 12/1987 | Maskasky | 430/569 |
| 4,783,398 | 11/1988 | Takada et al. | 430/567 |
| 4,804,621 | 2/1989 | Tufano et al. | 430/567 |
| 4,942,120 | 7/1990 | King et al. | 430/567 |
| 4,952,491 | 8/1990 | Nishikawa et al. | 430/570 |
| 4,983,508 | 1/1991 | Ishiguro et al. | 430/569 |
| 5,178,997 | 1/1993 | Maskasky | 430/569 |
| 5,178,998 | 1/1993 | Maskasky et al. | 430/569 |

FOREIGN PATENT DOCUMENTS 3-116133 5/1991 Japan .

OTHER PUBLICATIONS

Tufano, T. P., and Chan, D. M. T., "Aminopyrimidine Crystal Growth Modifiers for the Precipitation of Chloride-Rich Emulsion Grains with {111} Crystal Surfaces", SPSE vol. 34, No. 2, Sep., 1989.

*Primary Examiner*—Charles L. Bowers, Jr.
*Assistant Examiner*—Mark F. Huff
*Attorney, Agent, or Firm*—Carl O. Thomas

[57] ABSTRACT

A process of preparing a radiation sensitive high chloride high aspect ratio tabular grain emulsion is disclosed wherein silver ion is introduced into a high methionine gelatino-peptizer dispersing medium having a methionine content of greater than 30 μmoles/gram gelatin, containing a stoichiometric excess of chloride ions of greater than 0.5 molar, a pH of at least 4.5, and a 4,6-di(-hydroamino)-5-aminopyrimidine grain growth modifier, such as adenine or 4,5,6 triaminopyrimidine.

17 Claims, No Drawings

PROCESS FOR THE PREPARATION OF HIGH CHLORIDE TABULAR GRAIN EMULSIONS

FIELD OF INVENTION

The invention relates to processes for the precipitation of radiation sensitive silver halide emulsions useful in photography and, more particularly, to a process of preparing a high chloride tabular grain emulsion using a gelatinopeptizer dispersing medium comprising a methionine content of greater than 30 μm moles/gram gelatin and a 4,6-di(hydroamino)-5-amino pyrimidine grain growth modifier.

BACKGROUND OF THE INVENTION

Radiation sensitive silver halide emulsions containing one or a combination of chloride, bromide and iodide ions have been long recognized to be useful in photography. Each halide ion selection is known to impart particular photographic advantages. Although known and used for many years for selected photographic applications, the more rapid developability and the ecological advantages of high chloride emulsions have provided an impetus for employing these emulsions over a broader range of photographic applications. As employed herein the term "high chloride emulsion" refers to a silver halide emulsion containing at least 50 mole percent chloride and less than 5 mole percent iodide, based on total silver.

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multiemulsion layer formats, can be realized by increasing the proportions of selected tabular grain populations in photographic emulsions.

The various photographic advantages were associated with achieving high aspect ratio tabular grain emulsions. As herein employed and as normally employed in the art, the term "high aspect ratio tabular grain emulsion" has been defined as a photographic emulsion in which tabular grains having a thickness of less than 0.35 μm and an average aspect ratio of greater than 8:1 account for at least 50 percent of the total grain projected area of emulsion. Aspect ratio is the ratio of tabular grain effective circular diameter (ECD), divided by tabular grain thickness (t).

Although the art has succeeded in preparing high chloride tabular grain emulsions, the inclusion of high levels of chloride as opposed to bromide, alone or in combination with iodide, has been difficult. The basic reason is that tabular grains are produced by incorporating parallel twin planes in grains grown under conditions favoring [111] crystal faces. The most prominent feature of tabular grains are their parallel [111] major crystal faces.

To produce successfully a high chloride tabular grain emulsion two obstacles must be overcome. First, conditions must be found that incorporate parallel twin planes into the grains. Second, the strong propensity of silver chloride to produce [100] crystal faces must be overcome by finding conditions that favor the formation of [111] crystal faces. Methods for the preparation of tabular chloride-containing grains with substantially parallel, major [111] crystal faces have been set forth. For example, Wey U.S. Pat. No. 4,399,215, produced the first silver chloride high aspect ratio (ECD/t>8) tabular grain emulsion. Wey teaches an ammoniacal double jet precipitation technique under prescribed pH (8–10) and pAg (6.5–10) in a conventional gelatin precipitation medium to promote very large, thick tabular grain growth. However, the thickness of the emulsions was substantially greater than 0.35 μm, largely compared to contemporaneous silver bromide and bromoiodide tabular grain emulsions. This was due to the extreme ripening conditions provided by the high pH ammoniacal environment. A further disadvantage was that significant reductions in the aspect ratio occurred when bromide and/or iodide ions were included in the tabular grains.

In another process, Wey et al. U.S. Pat. No. 4,414,306, developed a method for preparing tabular grain silver chlorobromide emulsions. The process relies on careful control of the molar ratio between the chloride and bromide ions. Consequently, the final chloride of the grains produced in accordance with this process is limited to 40 mole percent chloride based on total silver. Thus, this process of preparation has not been successfully extended to high chloride emulsions.

Maskasky U.S. Pat. No. 4,400,463 (hereinafter designated Maskasky I) has shown that aminoazaindene growth modifiers, such as adenine, in combination with specific synthetic peptizers having a thioether linkage can be used to make high chloride, high aspect ratio tabular grain emulsions. The synthetic peptizer is used in place of gelatin to produce emulsion grains which are at least 50 mole percent chloride, having a thickness of less than 0.5 μm and which can be formed in acidic media. The principal disadvantage of this approach has been the necessity of employing a synthetic peptizer as opposed to gelatin-peptizers which are almost universally employed in photographic emulsions.

Further investigations into using grain growth modifiers for preparing high chloride tabular grain emulsions has been conducted. For example, Takada et al. U.S. Pat. No. 4,783,398, employs heterocycles containing a divalent sulfur ring atom which form tabular grains having at least 50 mole percent chloride, aspect ratios between 2:1 and 10:1 in the presence of a conventional gelatin peptizer; Nishikawa et al. U.S. Pat. No. 4,952,491, employs spectral sensitizing dyes and divalent sulfur atom containing heterocycles and acyclic compounds; and Ishiguro et al. U.S. Pat. No. 4,983,508, employs organic bis-quaternary amine salts.

Maskasky U.S. Pat. No. 4,713,323 (hereinafter designated Maskasky II), subsequently extended the technology of Maskasky I to the growth of tabular grains in gelatin. Here, high chloride tabular grain emulsions could be prepared by running silver salt into a dispersing medium containing at least a 0.5 molar concentration of chloride ion, an oxidized gelatino-peptizer employing aminoazaindene crystal growth modifiers. An oxidized gelatino-peptizer is a gelatino-peptizer treated with a strong oxidizing agent to modify by oxidation (and eliminate or reduce as such) the methionine content of the peptizer. The gelatin used in this process must be specially oxidized (with hydrogen peroxide, for example) to reduce the methionine content of the peptizer to a level of less than 30 micromoles per gram. Maskasky specifically investigated the use of a gelatinopeptizer containing 56 micromoles methionine per gram gelatin in the process, but failed to obtain tabular grains. King et al., U.S. Pat. No. 4,942,120, is essentially cumulative, differing only in that methionine was modified by alkylation.

As employed herein, the term "low methionine gelatin" refers to a gelatino-peptizer having a methionine content of less than 30 micromoles per gram of gelatin, as disclosed in Maskasky II. The term "high methionine gelatin" refers to a gelatino-peptizer having a methionine content of greater than 30 micromoles per gram of gelatin.

Tufano et al. U.S. Pat. No. 4,804,621 discloses processes for the precipitation of high aspect ratio tabular chloride-rich emulsion grains, using a narrowly defined class of grain growth modifiers in a conventional gelatin media. Tufano et al. observed that over a wide range of chloride ion concentrations ranging from pCl0 to 3 (1 to $1\times10^{-3}$M) and a wide range of pH levels, ranging from 2.5 to 9, selected 4,6-diaminopyrimidines were capable of promoting the formation of tabular grains. However, Tufano et al. specifically investigated the use of a 4,6-di(hydroamino)-5-aminopyrimidine (specifically, adenine), but failed to obtain tabular grains using these compounds and explicitly excluded the possibility of having an amino substituent present in the 5-position on the pyrimidine ring.

In the industry, the cost of using low methionine gelatin is about 20 percent more than if high methionine gelatin were employed. Additionally, employing adenine as a growth modifier is generally preferred since it is lower in cost and less toxic of a compound when compared to other growth modifiers. It is apparent that a need exists for providing a process for precipitating high aspect ratio tabular grain emulsions in a high chloride environment which utilizes a high methionine gelatin and a 4,6-di(hydroamino)-5-aminopyrimidine, preferably adenine, as a growth modifier.

RELATED PATENT APPLICATIONS

Maskasky U.S. Ser. No. 762,971, commonly assigned, now U.S. Pat. No. 5,178,997, titled PROCESS FOR THE PREPARATION OF HIGH CHLORIDE TABULAR GRAIN EMULSIONS (II), (hereinafter designated Maskasky III) discloses a process for preparing a high chloride tabular grain emulsion in which silver ion is introduced into a gelatino-peptizer dispersing medium containing a stoichiometric excess of chloride ions of less than 0.5 molar and a grain growth modifier of the formula:

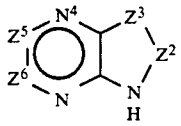

where $Z^2$ is —C($R^2$)= or —N=;
$Z^3$ is —C($R^3$)= or —N=;
$Z^4$ is —C($R^4$)= or —N=;
$Z^5$ is —C($R^5$)= or —N=;
$Z^6$ is —C($R^6$)= or —N=;
with the proviso that no more than one of $Z^4$, $Z^5$ and $Z^6$ is —N=;
$R^2$ is H, $NH_2$ or $CH_3$;
$R^3$, $R^4$ and $R^5$ are independently selected, $R^3$ and $R^5$ being hydrogen, hydroxy, halogen, amino or hydrocarbon and $R^4$ being hydrogen, halogen or hydrocarbon, each hydrocarbon moiety containing from 1 to 7 carbon atoms; and
$R^6$ is H or $NH_2$.

Maskasky and Chang U.S. Ser. No. 763,013, filed Sep. 20, 1991, commonly assigned, U.S. Pat. No. 5,178,998, titled IMPROVED PROCESS FOR THE PREPARATION OF HIGH CHLORIDE TABULAR GRAIN EMULSIONS (III), (hereinafter designated Maskasky et al. I) discloses a process for preparing a high chloride tabular grain emulsion in which silver ion is introduced into a gelatino-peptizer dispersing medium containing a stoichiometric excess of chloride ions of less than 0.5 molar and a grain growth modifier of the formula:

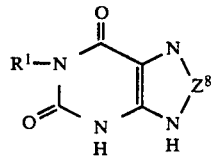

where $Z^8$ is —C($R^8$)= or —N=;
$R^8$ is H, $NH_2$ or $CH_3$; and
$R^1$ is hydrogen or a hydrocarbon containing from 1 to 7 carbon atoms.

The grain growth modifier is not a 2-hydroaminoazine.

Maskasky and Chang U.S. Ser. No. 820,181, commonly assigned, now U.S. Pat. No. 5,176,992, titled PROCESS FOR THE PREPARATION OF A GRAIN STABILIZED HIGH CHLORIDE TABULAR GRAIN PHOTOGRAPHIC EMULSION (II) (hereinafter referred to as Maskasky et al. II), discloses a process of preparing an emulsion for photographic use comprising (a) forming an emulsion as taught by Maskasky et al. I, above, (b) reducing the pH of the dispersing medium below 4.0 to inactivate the xanthinoid as a morphological stabilizer, and (c) replacing the inactivated xanthinoid on the tabular grain surfaces by adsorption of the photographically useful compound, the photographically useful compound being selected from among those containing at least one divalent sulfur atom, thereby concurrently morphologically stabilizing the tabular grains and enhancing their photographic utility.

Maskasky U.S. Ser. No. 819,712, commonly assigned, now U.S. Pat. No. 5,185,239, (as a continuation in part of U.S. Ser. No. 763,382, filed Sep. 20, 1991) titled PROCESS FOR THE PREPARATION OF HIGH CHLORIDE TABULAR GRAIN EMULSIONS (IV), (hereinafter designated Maskasky IV), discloses a process for preparing a high chloride tabular grain emulsion in which silver ion is introduced into a gelatino-peptizer dispersing medium containing stoichiometric excess of chloride ions of less than 0.5 molar, a pH of at least 4.6, and a triaminopyrimidine grain growth modifier containing mutually independent 4, 5 and 6 ring position amino substituents with the 4 and 6 ring position substituents being hydroamino substituents. This grain growth modifier is a 2-hydroaminoazine species.

Maskasky U.S. Ser. No. 763,382, commonly assigned now U.S. Pat. No. 5,183,732 (as a continuation in part of U.S. Pat. Ser. No. 763,382, filed Sep. 20, 1991) titled IMPROVED PROCESS FOR THE PREPARA- TION OF HIGH CHLORIDE TABULAR GRAIN EMULSIONS (V), (hereinafter designated Maskasky V), discloses a process for preparing a high chloride tabular grain emulsion in which silver ion is introduced into a gelatino-peptizer dispersing medium containing a stoichiometric excess of chloride ions of less than 0.5 molar, a pH of at least 4.6 and a 2-hydroaminoazine grain growth modifier of the formula:

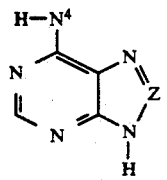

where $N^4$ is an amino moiety and

Z represents the atoms completing a 5 or 6 member ring.

Maskasky U.S. Ser. No. 820,182, commonly assigned, now allowed (as a continuation in part of U.S. Ser. No. 763,030, filed Sep. 30, 1991), titled IMPROVED PROCESS FOR THE PREPARATION OF HIGH CHLORIDE TABULAR GRAIN EMULSIONS (VI), (hereinafter designated Maskasky VI), discloses preparing an emulsion for photographic use comprised of silver halide grains and a gelatino-peptizer dispersing medium in which morphologically unstable tabular grains having [111] major faces account for greater than 50 percent of total grain projected area and contain at least 50 mole percent chloride, based on silver. The emulsion additionally contains at least one 2-hydroaminoazine absorbed to and morphologically stabilizing the tabular grains. The 2-hydroaminoazine is protonated, thereby released from the tabular grain surfaces into the dispersing medium. The released 2-hydroaminoazine is replaced on the tabular grain surfaces by adsorption of a photographically useful compound selected from among those that contain at least one divalent sulfur atom, thereby concurrently morphologically stabilizing the tabular grains and enhancing their photographic utility, and the released 2-hydroaminoazine is removed from the dispersing medium.

SUMMARY OF THE INVENTION

The primary object of the present invention is to provide a process for the precipitation of high chloride high aspect ratio tabular grain emulsions.

Another object of the present invention is to provide such an emulsion using a high methionine gelatino-peptizer.

Another object of the present invention is to provide such an emulsion using a 4,6-di(hydroamino)-5-aminopyrimidine grain growth modifier, preferably adenine.

In one aspect, this invention is directed to a process of preparing a radiation sensitive high chloride high aspect ratio tabular grain emulsion, wherein tabular grains of less than 0.35 μm in thickness and an average aspect ratio of greater than 8:1 account for greater than 50 percent of the total grain projected area, the tabular grains containing at least 50 mole percent chloride, based on silver, comprising introducing silver ion into a high methionine gelatino-peptizer dispersing medium containing a stoichiometric excess of chloride ions of greater than 0.5 molar, a pH of at least 4.5, and a 4,6-di(-hydroamino)-5-aminopyrimidine grain growth modifier.

It has been discovered quite unexpectedly that a high aspect ratio high chloride tabular grain emulsion can be produced using a high methionine gelatino-peptizer, preferably containing 59.7 micromoles of methionine per gram of gelatin, by properly selecting the stoichiometric excess of chloride ion, the pH and by including in the dispersing medium a 4,6-di(hydroamino)-5-aminopyrimidine grain growth modifier, preferably adenine. The practical significance of being able to employ this class of pyrimidines which includes adenine (a.k.a. Vitamin $B_4$), is that adenine is the most readily available of all aminopyrimidines and one of the least toxic.

Additionally, the cost of high methionine gelatin is about 20 percent less expensive than that of low methionine gelatin. Thus, a cost savings is realized during the manufacturing process when using the present invention. Further advantages of the process of the present invention include (1) the process is easier to control because high chloride excess halide level is used; and (2) the process allows for using "single jet precipitation" which is a simplified precipitation procedure.

The disadvantages of the prior art, for example, Maskasky I requiring a synthetic peptizer, Maskasky II requiring a peptizer with a low methionine content i.e. generally reduced by oxidation, and Maskasky III, IV, V and Maskasky et al. I requiring a stoichiometric excess of chloride ion of less than 0.5 molar are also avoided. Thus, a novel process is provided by this invention which offers a more attractive route to providing a high chloride high aspect ratio tabular grain emulsion.

DESCRIPTION OF PREFERRED EMBODIMENTS

The present invention is directed to an improved process of preparing a high chloride high aspect ratio tabular grain emulsion.

An aqueous gelatino-peptizer dispersing medium is present during precipitation. As used herein, "gelatino-peptizer" includes gelatin—e.g., alkali-treated gelatin (cattle bone and hide gelatin) or acid-treated gelatin (pigskin gelatin) and gelatin derivatives—e.g., acetylated gelatin, phthalated gelatin, and the like. The process of the present invention is restricted to use of high methionine gelatino-peptizers. As stated elsewhere herein, a high methionine gelatin contains a methionine content of greater than 30 micromoles/gram of gelatin. More preferably, high methionine gelatin comprises a methionine content of between 35 micromoles to about 80 micromoles per gram of gelatin. Most preferably, a high methionine gelatin having a methionine content of about 59.7 micromoles/gram of gelatin is utilized in the present process.

During the precipitation of photographic silver halide emulsions there is conventionally a slight stoichiometric excess of halide ion present. This avoids the possibility of excess silver ion being reduced to metallic silver and resulting in photographic fog. The stoichiometric excess of chloride ion in the dispersing medium is maintained at a level of greater than 0.5M. It is generally preferred that the chloride ion concentration in the dispersing medium be between about greater than 0.5M and 2M and, optimally, equal to between about 0.6M and 1.5M. Whereas the examples of Maskasky III, IV, V and Maskasky et al. I report a stoichiometric excess of chloride ion present in the dispersing medium at a level of less than 0.5 molar.

In accordance with the processes of the present invention, the pH of the dispersing medium is maintained at a level of at least 4.5 . Whereas examples disclosed in Maskasky I report relevant halide compositions at a pH of 2.6 and 3.0, examples disclosed in Maskasky II employ a pH of 4.0 and Tufano et al. discloses a pH of 4.0 for the adenine control. In Maskasky IV it has been discovered that, for 4,6-di(hydroamino)-5-aminopyrimidines to be effective growth modifiers in gelatino-peptizers with a limited stoichiometric excess of chloride ion present i.e., less than 0.5M, the pH must have a value of at least 4.6. In the present invention, for adenine to be an effective growth modifier in nonoxidized gelatino-peptizers with a stoichiometric excess of chloride ion present of greater than 0.5M, the pH should have a value of at least 4.5. The maximum pH contemplated during precipitation may range up to about 7.0. It is generally preferred to conduct precipitation in the pH range of from about 5.0 to about 6.0. A strong mineral acid, such as nitric acid or sulfuric acid, or a strong mineral base, such as an alkali hydroxide, can be employed to adjust the pH within a selected range. When a basic pH is to be maintained, it is preferred not to employ ammonium hydroxide, since it has the unwanted effect of acting as a ripening agent and is known to thicken tabular grains. However, to the extent that thickening of the tabular grains does not exceed the 0.35 μm thickness limit, ammonium hydroxide or other conventional ripening agents (e.g., thioether or thiocyanate ripening agents) can be present within the dispersing medium.

Any convenient conventional approach of monitoring and maintaining replicable pH profiles during repeated precipitations can be employed. For example, reference is made to Research Disclosure Vol. 308, December, 1989, Item 308,119, the disclosure of which is hereby incorporated by reference. Maintaining a pH buffer in the dispersing medium during precipitation arrests pH fluctuations and facilitates maintenance of pH within selected limited ranges. For purposes of illustration only, and not limitation, buffers for maintaining relatively narrow pH limits within the ranges noted above include sodium or potassium acetate, phosphate, oxalate and phthalate as well as tris(hydroxymethyl)amino-methane.

In addition to the precipitation criteria noted above, it is contemplated to have present in the dispersing medium a 4,6-di(hydroamino)-5-aminopyrimidine grain growth modifier. As employed herein the term "hydroamino" designates an amino group containing at least one hydrogen substituent—i.e., a primary or secondary amino group. The 5 positive amino ring substituent may be a primary, secondary or tertiary amino group. Each of the 4,5 and 6 ring position amino substituents may be independent of the other or an adjacent amino nitrogen can share substituent groups to complete a 5 or 6 membered ring fused with the pyrimidine ring.

A preferred 4,6-di(hydroamino)-5-aminopyrimidine grain growth modifier within the scope of the present invention may satisfy the following format:

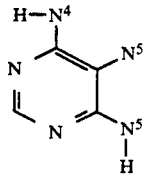

where $N^4$, $N^5$ and $N^6$ are amino moieties independently containing hydrogen or hydrocarbon substituents of from 1 to 7 carbon atoms, with the proviso that the $N^5$ amino moiety can share with each or either $N^4$ and $N^6$ a common hydrocarbon substituent completing a five or six member heterocyclic ring.

It is understood that in the simplest contemplated form each of $N^4$, $N^5$ and $N^6$ may be a primary amino group (—$NH_2$) or any one or combination of $N^4$, $N^5$ and $N^6$ may be a primary amino group. Alternatively, any one or combination of $N^4$, $N^5$ and $N^6$ may take the form of a secondary amino group (—NHR), where the substituent R is in each instance an independently chosen hydrocarbon containing from 1 to 7 carbon atoms. Preferably, R is an alkyl group—e.g., methyl, ethyl, n-propyl, i-propyl, n-butyl, i-butyl, t-butyl, etc., although other hydrocarbons, such as cyclohexyl or benzyl, are contemplated. To increase growth modifier solubility the hydrocarbon groups may, in turn, be substituted with polar groups, such as hydroxy, sulfonyl or amino groups, if desired, or the hydrocarbon can be substituted with other groups that do not materially alter their properties (e.g., a halo substituent).

In another alternative form $N^5$ can, independently of $N^4$ and $N^6$, take the form of a tertiary amino group (—$NR_2$), where R is as described above. Instead of the hydrocarbon substituents of each amino group being independent of the remaining amino groups, it is recognized that adjacent pairs of amino substituents may share a common hydrocarbon substituent. When this occurs, the adjacent pair of amino groups and their shared substituent complete a heterocyclic ring fused with the pyrimidine ring. Preferred shared hydrocarbon substituents are those that complete a 5 or 6 membered heterocyclic ring.

In a more preferred embodiment of the invention, $N^5$ and $N^6$ share a hydrocarbon substituent to form an imidazolo ring fused with the pyrimidine ring. This results in a 6-hydroaminopurine structure of the following formula:

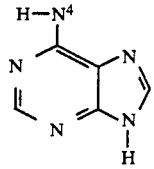

where $N^4$ is as previously defined. In the most preferred embodiment, when the H—$N^4$-substituent is a primary amino group (i.e., $H_2N$—), the resulting compound is adenine:

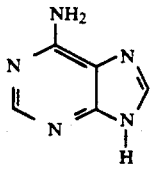

Instead of an imidazolo fused ring, as found in purines, the fused ring formed by the hydrocarbon substituent shared by $N^5$ and $N^6$ may complete an imidazolino, dihydropyrazino or tetrahydropyrazino ring. When the hydrocarbon shared by the $N^5$ and $N^6$ amino groups is a saturated hydrocarbon (i.e., an alkanediyl), it is structurally possible for $N^5$ to share a hydrocarbon substituent with each of $N^4$ and $N^6$. For example, two imidazolino rings can be fused with the pyrimidine ring or an imidazolino ring and a tetrahydropyrazino ring can both be fused with the pyrimidine ring.

The following list sets forth illustrations of various 4,6-di(hydroamino)-5-aminopyrimidine compounds within the scope of the present invention:

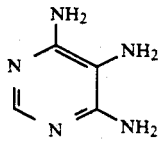

PY-1 4,5,6-Triaminopyrimidine

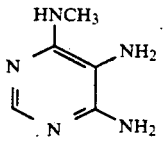

PY-2 5,6-Diamino-4-(N-methylamino) pyrimidine

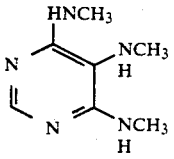

PY-3 4,5,6-Tri(N-methylamino) pyrimidine

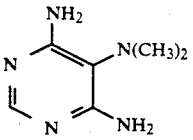

Py-4 4,6-Diamino-5-(N,N-dimethylamino) pyrimidine

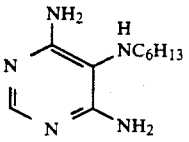

PY-5 4,6-Diamino-5-(N-hexylamino) pyrimidine

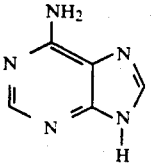

PY-6 Adenine

-continued

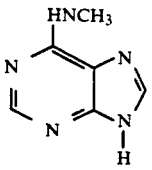

PY-7 6-(N-Methylamino) purine

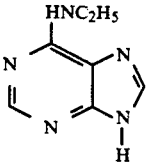

PY-8 6-(N-Ethylamino) purine

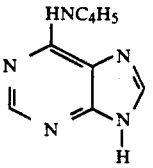

PY-9 6-(N-Butylamino) purine

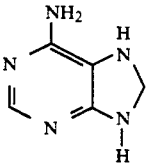

PY-10 6-Amino-7, 8-dihydropurine

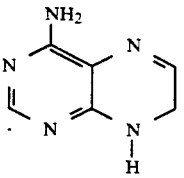

PY-11 4-Amino-7, 8-dihydropteridine

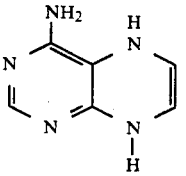

PY-12 4-Amino-5, 8-dihydropteridine

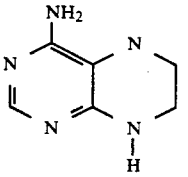

PY-13 4-Amino-5,6,7,8-tetrahydropteridine

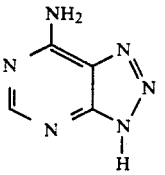

PY-14 8-Azaadenine

-continued

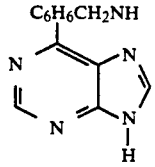

PY-15 6-Benzylaminopurine

When employing the most preferred 4,6-di(hydroamino)-5-aminopyrimide, adenine, in the presence of a high methionine gelatin peptizer, the following considerations must be taken into account.

Both adenine and methionine (in the gelatin) bind with silver ions. That is, these two chemicals compete with one another. When the methionine concentration is much higher than that of the adenine, the majority of the faces in the silver chloride are covered by the methionine, thus leaving few surface sites for adenine adsorption. This leads to very few [111] face modifications and no tabular grain formation as a result.

To promote adenine adsorption in the presence of high methionine gelatin, one has to either increase the concentration of adenine or increase the effectiveness of adenine adsorption. Adenine may be present in three forms in equilibrium with each other depending on the pH value: (1) protonated ($AdH^+$); (2) adenine (Ad) and; (3) deprotonated ($Ad^-$).

$$AdH^+ \underset{pK_1}{\longleftrightarrow} Ad \underset{pK_2}{\longleftrightarrow} Ad^- \quad (1)$$

Where $pK_1=4.22$, $pK_2=9.87$ and enthalpy of the above reactions are $H_1=4.81$ Kcal/mole, $H_2=9.65$ Kcal/mole at room temperature. From the information, the equilibrium constant may be calculated at any given temperature using the following formula:

$$K=K^{ref}\exp[-H^{ref}/R(1/T-1/T^{ref})] \quad (2)$$

With reference to Table 1, there is shown the equilibrium distribution of the three forms of adenine at various pH and temperature.

TABLE I

EQUILIBRIUM DISTRIBUTION OF ADENINE

| pH | 25° C. (80° C.) ($AdH^+$) | (Ad) | ($Ad^-$) |
|---|---|---|---|
| 3 | 0.94 | 0.05 | 0 |
| | (0.82) | (0.17) | 0 |
| 4 | 0.62 | 0.37 | 0 |
| | (0.32) | (0.68) | 0 |
| 5 | 0.14 | 0.85 | 0 |
| | (0.05) | (0.95) | 0 |
| 6 | 0.01 | 0.98 | 0 |
| | (0.01) | (0.99) | 0 |
| 7 | 0 | 0.98 | 0 |
| | (0) | (0.98) | (0.02) |
| 8 | 0 | 0.98 | (0.013) |
| | (0) | (0.84) | (0.157) |

The non-protonated adenine, Ad, is the active form of the growth modifier. Significant amounts of this form, relative to the $AdH^+$ and $Ad^-$ forms exist over the pH range of about 4.5 to in excess of 8.0. Since making high chloride emulsions at a pH of greater than 7.0 would result in unacceptably high image fog when used as a photographic image forming material, the useful pH range is limited to about 4.5 to about 7.0.

Both the high methionine gelatino-peptizer and the adenine growth modifier compete for adsorption on the surfaces of the grains. It was found to be advantageous to enhance the adsorption of adenine by using a lower concentration of the high methionine gelatin during nucleation than that used during grain growth to achieve improved tabular grain mean aspect ratios. Useful gelatin levels during the nucleation portion of the precipitation are typically about 0.1%.

It has been discovered in the present invention that when there exists enough concentration of adenine for [111] faces, making AgCl T-grains with adenine and high methionine gelatin becomes possible.

In forming high chloride high aspect ratio tabular grain emulsions, tabular grains containing at least 50 mole percent chloride, based on silver, and having a thickness of less than 0.35 μm account for greater than 50 percent of the total grain projected area. In preferred emulsions the tabular grains having a thickness of less than 0.25 μm account for at least 70 percent of the total grain projected area and, optimally, at least 90 percent of the total grain projected area.

For tabular grains to satisfy the projected area requirement it is necessary first to induce twinning in the grains as they are being formed, since only grains having two or more parallel twin planes will assume a tabular form. Second, after twinning has occurred, it is necessary to restrain precipitation onto the major [111] crystal faces of the tabular grains, since this has the effect of thickening the grains. The 4,6-di(hydroamino)-5-aminopyrimidine grain growth modifiers employed in the practice of this invention are effective during precipitation to produce an emulsion satisfying both the tabular grain thickness and projected area parameters noted above.

It is generally recognized that inducing twin planes in the grains at a very early stage in their formation offers the capability of producing thinner tabular grains than can be achieved when twinning is delayed. For this reason it is usually preferred that the conditions within the dispersing medium prior to silver ion introduction at the outset of precipitation be chosen to favor twin plane formation. To facilitate twin plane formation it is contemplated to incorporate the 4,6-di(hydroamino)-5-aminopyrimidine grain growth modifier in the dispersing medium prior to silver ion addition in a concentration of at least $2\times10^{-4}$ M, preferably at least $5\times10^{-4}$ M, and optimally at least $7\times10^{-4}$ M. Generally little increase in twinning can be attributed to increasing the initial growth modifier concentration in the dispersing medium above 0.01M. Higher initial grain growth modifier concentrations up to 0.05M, 0.1M or higher, are not incompatible with the twinning function. The maximum growth modifier concentration in the dispersing medium is often limited by its solubility. It is contemplated to introduce into the dispersing medium growth modifier in excess of that which can be initially dissolved. Any undissolved growth modifier can provide a source of additional growth modifier solute during precipitation, thereby stabilizing growth modifier concentrations within the ranges noted above. It is preferred to avoid quantities of grain growth modifier in excess of those observed to control favorably tabular grain parameters.

Once a stable multiply twinned grain population has been formed within the dispersing medium, the primary, if not exclusive, function the grain growth modifier is called upon to perform is to restrain precipitation onto the major [111] crystal faces of the tabular grains, thereby retarding thickness growth of the tabular grains. In a well controlled tabular grain emulsion precipitation, once a stable population of multiply twinned grains has been produced, tabular grain thickness can be held essentially constant.

The amount of grain growth modifier required to control thickness growth of the tabular grain population is a function of the total grain surface area. Adenine has been long recognized to adsorb to [111] silver halide grain surfaces. By adsorption onto the [111] surfaces of the tabular grains the 4,6-di(hydroamino)-5-aminopyrimidines restrain onto the grain faces and shift further growth of the tabular grains to their edges.

The benefits of this invention can be realized using any amount of grain growth modifier that is effective to retard thickness growth of the tabular grains It is generally contemplated to have present in the emulsion during tabular grain growth sufficient grain growth modifier to provide a monomolecular absorbed layer over at least 25 percent, preferably at least 50 percent, of the total [111] grain surface area of the emulsion grains. Higher amounts of adsorbed grain growth modifier are, of course, feasible. Adsorbed grain growth modifier coverages of 80 percent of monomolecular layer coverage or even 100 percent are contemplated. In terms of tabular grain thickness control there is no significant advantage to be gained by increasing grain growth modifier coverages above these levels. Any excess grain growth modifier that remains unadsorbed is normally depleted in post-precipitation emulsion washing.

Prior to introducing silver salt into the dispersing medium at the outset of the precipitation process, no grains are present in the dispersing medium and the initial grain growth modifier concentrations in the dispersing medium are therefore more than adequate to provide the monomolecular coverage levels noted above as grains are initially formed. As tabular grain growth progresses it is a simple matter to add grain growth modifier, as needed, to maintain monomolecular coverages at desired levels, based on knowledge of amount of silver ion added and the geometrical forms of the graims being grown.

The 4,6-di(hydroamino)-5-aminopyrimidine grain growth modifiers described above are capable of use during precipitation as the sole grain growth modifier. That is, these grain growth modifiers are capable of influencing both twinning and tabular grain growth to provide high chloride high aspect ratio tabular grain emulsions.

It has also been discovered that improvements in precipitation may be realized by employing in the process of the present invention a combination of 4,6-di(hydroamino)-5-aminopyrimidine grain growth modifiers in which the more tightly adsorbed of the grain growth modifiers is employed for tabular grain thickness growth reduction and the less tightly adsorbed of the grain growth modifiers is employed for twinning.

It is also here contemplated to utilize thiocyanate ion in a similar manner to control tabular grain growth. The thiocyanate ion may be introduced into the dispersing medium as any conventional soluble salt, typically an alkali or alkaline earth thiocyanate salt. For a more detailed description, see U.S. Pat. No. 5,061,617, "An Improved Process For The Preparation Of High Chloride Tabular Grain Emulsions", the disclosure of which is hereby incorporated by reference. It is still further contemplated to employ other conventional growth modifiers, such any of those disclosed by Takada et al., Nishikawa et al., Ishiguro et al. and Tufano et al., as elsewhere described herein, and the disclosures of which are hereby incorporated by reference.

Since silver bromide and silver iodide are markedly less soluble than silver chloride, it is appreciated that bromide and/or iodide ions, if introduced into the dispersing medium, are incorporated into the grains in the presence of the chloride ions. The inclusion of bromide ions in even small amounts has been observed to improve the tabularities of emulsions. Therefore, bromide ion concentrations of up to 50 mole percent, based on total silver, are within the scope of the present invention. Further, to increase the advantages of high chloride concentrations it is preferred to limit the presence of other halides so that chloride accounts for at least 80 mole percent, based on silver, of the completed emulsion. Iodide may be incorporated into the grains as they are being formed. However, it is preferred to limit iodide concentrations to 2 mole percent or less based on total silver. Thus, the process of the invention is capable of producing high chloride tabular grain emulsions in which the tabular grains consist essentially of silver chloride, silver bromochloride, silver iodochloride or silver iodobromochloride, where the halides are designed in order of ascending concentrations.

Either single-jet or double-jet precipitation techniques may be employed in the practice of the invention. Techniques for using single-jet precipitation are disclosed in U.S. Pat. No. 4,713,323 the disclosure of which is hereby incorporated by reference. Grain nucleation can occur before or instantaneously following the addition of silver ion to the dispersing medium. While sustained or periodic subsequent nucleation is possible, to avoid polydispersity and reduction to tabularity, once a stable grain population has been produced in the reaction vessel, it is preferred to precipitate additional silver halide onto the existing grain population.

In the most preferred approach of the present invention, silver ion is first introduced into the dispersing medium as an aqueous solution, such as a silver nitrate solution, resulting in instantaneous grain nuclei formation. Addition of the growth modifier, preferably adenine, to induce twinning and tabular grain growth is added only after nucleation is completed. This is to avoid formation of unnecessary silver-adenine salts. Thereafter, the precipitation pH is raised to reduce formation of protonated adenine which cannot serve as growth modifier.

Another possible approach is to introduce silver ion into the dispersing medium as preformed seed grains, typically as a Lippmann emulsion having an ECD of less than 0.5 μm. A small fraction of the Lippmann grains serve as deposition sites while the remaining Lippmann grains dissociate into silver and halide ions that precipitate onto grain nuclei surfaces. Techniques for using small, preformed silver halide grains as a feedstock for emulsion precipitation are illustrated by Mignot U.S. Pat. No. 4,334,012; Saito U.S. Pat. No. 4,301,241; and Solberg et al. U.S. Pat. No. 4,433,048, the disclosures of which are hereby incorporated by reference.

In still another approach, immediately following silver halide seed grain formation within or introduction into a reaction vessel, a separate step is provided to allow the initially formed grain nuclei to ripen. During the ripening step the proportion of untwinned grains can be reduced, thereby increasing the tabular grain content of the final emulsion. Also, the thickness and diameter dispersities of the final tabular grain population can be reduced by the ripening step. Ripening can be performed by stopping the flow of reactants while maintaining initial conditions within the reaction vessel or increasing the ripening rate by adjusting pH, the chloride ion concentration, and/or increasing the temperature of the dispersing medium. The pH, chloride ion concentration and grain growth modifier selections described above for precipitation can be first satisfied from the outset of silver ion precipitation or during the ripening step.

Except for the distinguishing features discussed above, precipitation according to the invention can take any convenient conventional form, such as disclosed in Research Disclosure Vol. 225, January 1983, Item 22534; Research Disclosure Vol. 308, December 1989, Item 308,119 (particularly Section I); Maskasky I, cited above; Wey et al., cited above; and Maskasky II, cited above; the disclosures of which are hereby incorporated by reference. It is typical practice to incorporate from about 20 to 80 percent of the total dispersing medium into the reaction vessel prior to nucleation. Although at the very outset of nucleation a peptizer is not essential, it is usually most convenient and practical to place peptizer in the reaction vessel prior to nucleation. Peptizer (high methionine gelatin) concentrations of from about 0.2 to 10 (preferably 0.2 to 6) percent, based on the total weight of the contents of the reaction vessel are typical, with additional peptizer and other vehicles typically to be added to emulsions after they are prepared to facilitate coating.

Once the nucleation and growth steps have been performed the emulsions can be applied to photographic applications following conventional practices. The emulsions can be used as formed or further modified or blended to satisfy particular photographic aims. It is possible, for example to practice the process of this invention and then to continue grain growth under conditions that degrade the tabularity of the grains and/or alter their halide content. It is also common practice to blend emulsions once formed with emulsions having differing grain compositions, grain shapes and/or tabular grain thicknesses and/or aspect ratios.

The invention can be better appreciated by reference to the following examples illustrating $A_gBr_xCl_{(1-x)}$ tabular grains formed in accordance with the present invention using high methionine gelatin at excess chloride concentration greater than 0.5 molar. With reference to Table II, there is shown a summary of the results of the emulsions made in accordance with the present invention. TGPA indicates the percentage of the total grain projected area accounted by tabular grains of less than 0.35 μm thickness.

TABLE II

| Emulsion No. | Cl/Br Ratio | Temp °C. | pH | % T-Grain by area (TGPA) | Size (μm) | Aspect |
|---|---|---|---|---|---|---|
| A. | 94/6 | 40 | 5.1 | >80 | 2.0 | 12 |
| B. | 100/0 | 40 | 5.1 | >70 | 2.1 | 9 |
| C. | 99/1 | 40 | 5.1 | >75 | 2.4 | 10 |
| D. | 97/3 | 40 | 5.6 | >80 | 1.6 | 13 |
| E. | 100/0 | 40 | 5.6 | >60 | 2.3 | 9 |
| F. | 90/10 | 40 | 5.6 | >80 | 1.8 | 16 |
| G. | 94/6 | 40 | 5.6 | >80 | 2.0 | 15 |

TABLE II-continued

| Emulsion No. | Cl/Br Ratio | Temp °C. | pH | % T-Grain by area (TGPA) | Size (μm) | Aspect |
|---|---|---|---|---|---|---|
| H. | 100/0 | 40 | 5.6 | >50 | 3.2 | 25 |

EXAMPLE I

Emulsion No. A-$AgBr_{.06}Cl_{.94}$ Tabular Grains

The reaction vessel, equipped with a stirrer, was charged with 6000 grams of distilled water containing 90 grams of high methionine gelatin, (containing 59.7 micromoles of methionine per gram of gelatin), 0.5M of $CaCl_2.2H_2O$ and 9.3 grams of NaBr. The pH was adjusted to 5.1 at 40° C. and maintained at that value throughout the precipitation by addition of NaOH or $HNO_3$. A 0.5M $AgNO_3$ solution was added over a 4 minute period at a rate consuming 1.6% of the total Ag used. The addition rate was then linearly accelerated over an additional period of 55 minutes (9.32 times from start to finish) during which time the remaining 98.4% of the Ag was consumed. 30 c.c. of 37 mM adenine solutions were added at 4, 16 and 36 minutes after precipitation started. 3.78 grams of 3M $CaCl_2$ solution was added at 10 minutes into the precipitation. During the addition of adenine and $CaCl_2$ solutions, silver flow was stopped for 1 minute to allow the additions to be uniformly mixed. A total of 1.44M of Ag was precipitated. The resulting $AgBr_{.06}Cl_{.94}$ tabular grain emulsion prepared in the presence of adenine, high methionine gelatin, at pH 5.1, yielded grains having an average size (diameter) of 2.0 μm, greater than 80% total grain projected area of thickness less than 0.35 μm and an aspect ratio of 12.

EXAMPLE II

Emulsion No. B-AgCl Tabular Grains

This emulsion was prepared similar to that of Example I, except that no NaBr was added to the reaction vessel. The resulting AgCl tabular grain prepared in the presence of adenine, high methionine gelatin at pH 5.1 yielded grains having an average size (diameter) of 2.1 μm, greater than 70% total grain projected area of thickness less than 0.35 μm and an aspect ratio of 9.

EXAMPLE III

Emulsion No. C-$AgBr_{.01}Cl_{.99}$ Tabular Grains

This emulsion was prepared similar to that of Example I, except that 1.5 grams of NaBr was added to the reaction vessel. The resulting $AgBr_{.01}Cl_{.99}$ tabular grain emulsion prepared in the presence of adenine, high methionine gelatin, at pH 5.1, yielded grains having an average size (diameter) of 2.4 μm, greater than 75% total grain projected area of thickness less than 0.35 μm and an aspect ratio of 10.

EXAMPLE IV

Emulsion No. D-$AgBr_{.03}Cl_{.97}$ Tabular Grains

The reactor vessel, equipped with a stirrer, was charged with 6000 grams of distilled water containing 30 grams of high methionine gelatin (containing 59.7 micromoles of methionine/gram gelatin), 0.7M of NaCl, 100 grams of 20 mM 4,5,6-triaminopyrimidine and 4.6 grams of NaBr. The pH was adjusted to 5.6 at 40° C. and maintained at that value throughout the precipitation by addition of NaOH or $HNO_3$. A 0.5M $AgNO_3$ solution was added over 1 minute period at a rate consuming 0.3% of the total Ag used. The addition rate was then linearly accelerated over an additional period of 55 minutes (9.8 times from start to finish) during which time the remaining 99.7% of the Ag was consumed. 120 c.c. of gelatin solutions were added at 1, 5 and 18 minutes after precipitation started. 400 grams of 4M NaCl solutions and 100 grams of 20 mM 4,5,6-triaminopyrimidine solutions were added at 5 and 18 minutes after the precipitation started. During the addition of the above materials, silver flow was stopped for 1 minute to allow the additions to be uniformly mixed. A total of 1.5 moles of Ag was precipitated. The resulting $AgBr_{.03}Cl_{.97}$ tabular grain emulsion prepared in the presence of high methionine gelatin, 4,5,6-triaminopyrimidine, at pH 5.6, yielded grains having an average size (diameter) of 1.6 μm, greater than 80% total grain projected area of thickness less than 0.35 μm and an aspect ratio of 13.

EXAMPLE V

Emulsion No. E-AgCl Tabular Grains

This emulsion was prepared similar to that of Example IV, except that no NaBr was added to the reaction vessel. The resulting AgCl tabular grain emulsion prepared in the presence of high methionine gelatin, 4,5,6-triaminopyrimidine, at pH 5.6, yielded grains having an average size (diameter) of 2.3 μm, greater than 60% total grain projected area of thickness less than 0.35 μm and an aspect ratio of 9.

EXAMPLE VI

Emulsion No. F-$AgBr_{.1}Cl_{.9}$ Tabular Grains

This emulsion was prepared similar to that of Example IV, except that 14 grams of NaBr was added to the reaction vessel. The resulting $AgBr_{.10}Cl_{.90}$ tabular grain emulsion prepared in the presence of high methionine gelatin, 4,5,6-triaminopyrimidine, at pH 5.6, yielded grains having an average size (diameter) of 1.8 μm, greater than 80% total grain projected area of thickness less than 0.35 μm and an aspect ratio of 16.

EXAMPLE VII

Emulsion No. G-$AgBr_{.06}Cl_{.94}$ Tabular Grains

This emulsion was prepared similar to that of Example I, except that 5 grams of high methionine gelatin was charged to the reaction vessel, in which the pH was maintained at 5.6. Nucleation silver stream was introduced consuming 0.3% of total silver in 1 minute. The solution additions were made at 1,16 and 36 minutes after precipitation started. Additionally, 120 grams of 10% gel solutions were added at the above time slots. The resulting $AgBr_{.06}Cl_{.94}$ tabular grain emulsion prepared in the presence of high methionine gelatin, adenine, at pH 5.6, yielded grains having an average size (diameter) of 2.0 μm, greater than 80% total grain projected area of thickness less than 0.35 μm and an aspect ratio of 15.

EXAMPLE VIII

Emulsion No. H-AgCl Tabular Grains

This emulsion was prepared similar to that of Example VII, except that no NaBr was added to the reaction vessel. The resulting AgCl tabular grain emulsion prepared in the presence of high methionine gelatin, adenine, at pH 5.6, yielded grains having an average size (diameter) of 3.2 μm, greater than 50% total grain projected area of thickness less than 0.35 μm and an aspect ratio of 25.

The invention has been described in detail with particular reference to preferred examples thereof, but it will be understood that variations and modifications can be effected within the spirit of the invention.

What is claimed is:

1. A process of preparing a radiation sensitive high aspect ratio tabular grain emulsion, wherein tabular grains of less than 0.35 μm in thickness and an average aspect ratio of greater than 8:1 account for greater than 50 percent of the total grain projected area, said tabular grains containing at least 50 mole percent chloride, based on silver, comprising introducing silver ions into a high methionine gelatino-peptizer dispersing medium containing during grain nucleation and growth a stoichiometric excess of chloride ions with respect to the silver ions, the concentration of the stoichiometric excess of chloride ions being greater than 0.5 molar, a pH of at least 4.5, and a 4,6-di (hydroamino)-5-aminopyrimidine grain growth modifier present in a molar concentration of at least $2\times10^{-4}$.

2. The process according to claim 1, wherein the stoichiometric excess of chloride ion is between about 0.5M and 2M.

3. The process according to claim 1, wherein the stoichiometric excess of chloride ion is between greater than 0.6M and 1.5M.

4. The process according to claim 1, wherein the pH is in the range of from 4.5 to 7.0.

5. The process according to claim 1, wherein the 4,6-di(hydroamino)-5-aminopyrimidine grain growth modifier satisfies the formula:

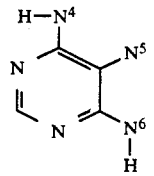

where $N^4$, $N^5$ and $N^6$ are amino moieties independently containing hydrogen or hydrocarbon substituents of from 1 to 7 carbon atoms, with the proviso that the $N^5$ amino moiety can share with each or either of $N^4$ and $N^6$ a common hydrocarbon substituent completing a five or six member heterocyclic ring.

6. The process according to claim 5, wherein the $N^5$ and $N^6$ share a common hydrocarbon substituent completing a five or six membered ring.

7. The process according to claim 6, wherein the five or six membered ring is an imidazolo, imidazolino, dihydropyrazino or tetrahydropyrazino ring.

8. The process according to claim 7, wherein the 4,6-di(hydroamino)-5-aminopyrimidine satisfies the formula:

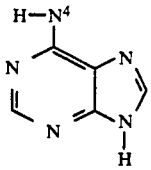

where $N^4$ is a primary or secondary amino group.

9. The process according to claim 8, wherein the 4,6-di(hydroamino)-5-aminopyrimidine is adenine.

10. The process according to claim 5, wherein the 4,6-di(hydroamino)-5-aminopyrimidine is 4,5,6-triaminopyrimidine.

11. The process according to claim 1, wherein the tabular grains contain less than 2 mole percent iodide, based on silver.

12. The process according to claim 1, wherein the tabular grains consist essentially of silver chloride.

13. The process according to claim 1, wherein the high methionine gelatino-peptizer comprises a methionine content of greater than 30 μm/gram of gelatin.

14. A process of preparing a radiation sensitive high aspect ratio tabular grain emulsion, wherein tabular grains of less than 0.25 μm in thickness and an average aspect ratio of greater than 8:1 account for greater than 50 percent of the total grain projected area, said tabular grains containing at least 50 mole percent chloride and less than 2 mole percent iodide, based on silver, comprising introducing silver ions into a nonoxidized gelatino-peptizer having a methionine content of greater than 35 micromoles per gram dispersing medium containing during grain nucleation and growth:

a stoichiometric excess of chloride ions with respect to the silver ions, the concentration of the stoichiometric excess of chloride ions being greater than 0.5 molar;

a pH of from 5.0 to 7.0; and adenine in a concentration of from $7\times10^{-4}$ to 0.05 molar.

15. The process according to claim 14, wherein adenine is present during twin plane formation in the tabular grains.

16. The process according to claim 14, wherein adenine is present during grain growth following introduction of twin planes in the tabular grains.

17. A process of preparing a radiation sensitive high aspect ratio tabular grain emulsion, wherein tabular grains of less than 0.25 μm in thickness and an average aspect ratio of greater than 8:1 account for greater than 50 percent of the total grain projected area, said tabular grains containing at least 50 mole percent chloride and less than 2 mole percent iodide, based on silver, comprising introducing silver ions into a nonoxidized gelatino-peptizer having a methionine content of greater than 35 μm moles/gram dispersing medium containing during grain nucleation and growth:

a stoichiometric excess of chloride ions with respect to the silver ions, the concentration of the stoichiometric excess of chloride ions being greater than 0.5 molar;

a pH of from 5.0 to 7.0; and 4,5,6-triaminopyrimidine in a concentration of from $7\times10^{-4}$ to 0.05 molar.

* * * * *